US005245942A

United States Patent [19]

Constantinis

[11] Patent Number: 5,245,942

[45] Date of Patent: Sep. 21, 1993

[54] SYSTEM FOR LAUNCHING A LIFEBOAT

[75] Inventor: Daniel A. Constantinis, Wilmslow, United Kingdom

[73] Assignee: E M & I (Safety Systems) Limited, Cheshire, England

[21] Appl. No.: 836,293

[22] PCT Filed: Aug. 30, 1990

[86] PCT No.: PCT/GB90/01344

§ 371 Date: Feb. 28, 1992

§ 102(e) Date: Feb. 28, 1992

[87] PCT Pub. No.: WO91/03398

PCT Pub. Date: Mar. 21, 1991

[30] Foreign Application Priority Data

Aug. 31, 1989 [GB] United Kingdom ..... 8919647

[51] Int. Cl.[5] ..... B63B 23/38

[52] U.S. Cl. ..... 114/366

[58] Field of Search ..... 114/365-366, 114/375; 182/48, 49, 191-193; 441/87

[56] References Cited

U.S. PATENT DOCUMENTS 3,796,281 3/1974 Dowling ..... 182/48

4,711,196 12/1987 Wilks ..... 114/365

FOREIGN PATENT DOCUMENTS 1297771 11/1972 United Kingdom .

*Primary Examiner*—Jesûs D. Sotelo

*Attorney, Agent, or Firm*—Nies, Kurz, Bergert & Tamburro

[57] ABSTRACT

A system for launching a lifeboat (13) from davits (14) on an off-shore drilling platform (10) comprises a submerged buoyancy device (16) tethered to the bow of the lifeboat (13) by a cable (17) which passes between the device (16) and the lifeboat. The cable (17) is retained by an inverted hook (18) and passes around pulleys (20 and 22) and is anchored to the sea bed (at 23). In use, as the lifeboat descends, a ring (26) attached to the cable (17) releases same from hook (18) causing buoyancy device (16) to ascend rapidly to the surface thus towing the lifeboat away from the platform (10) to a position (13') some 100 meters away from the platform.

12 Claims, 1 Drawing Sheet

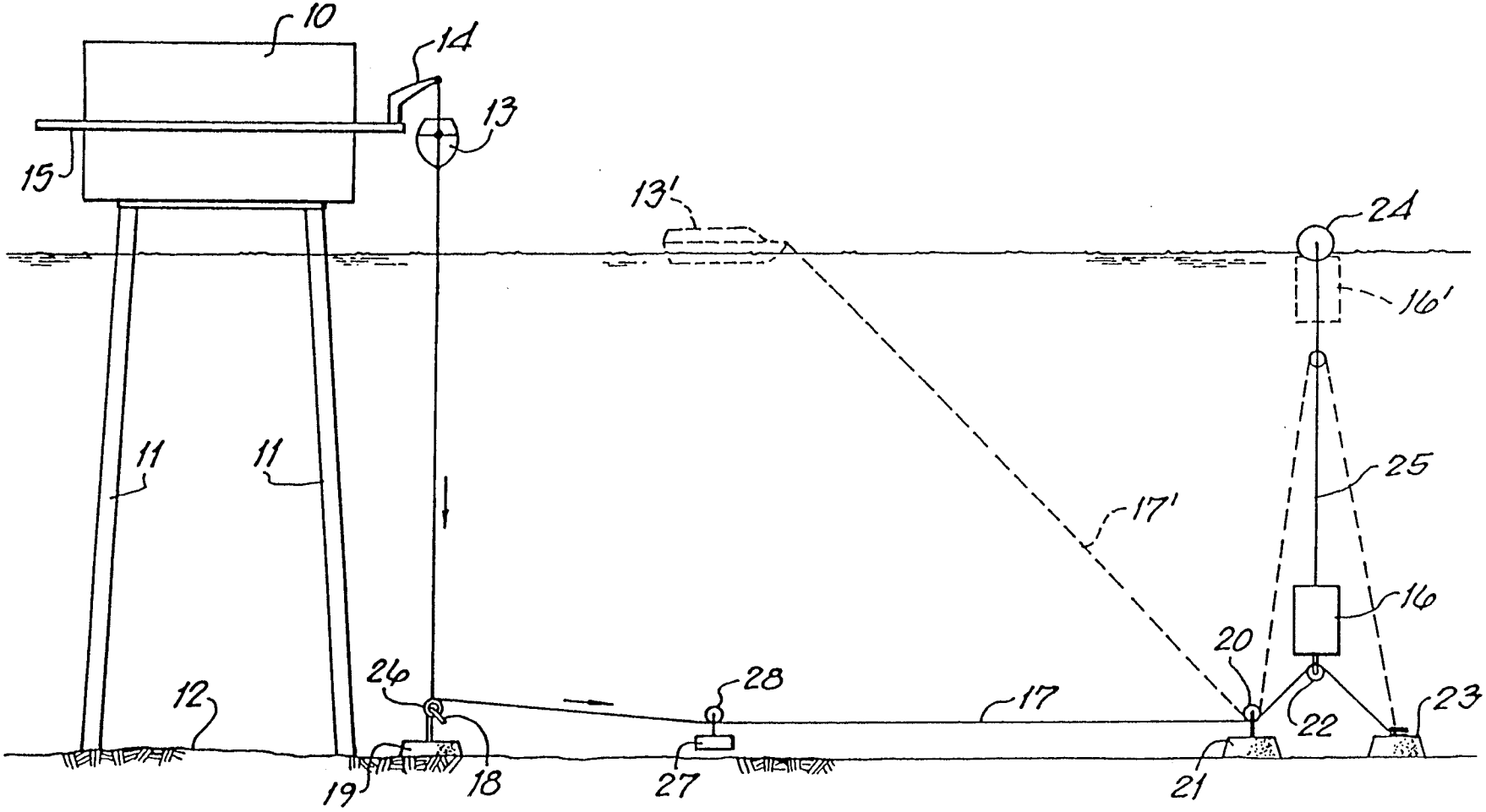
10
11
11
12
13
13'
14
15
16
16'
17
17'
18
19
20
21
22
23
24
25
26
27
28

SYSTEM FOR LAUNCHING A LIFEBOAT

THIS INVENTION concerns a system for launching a lifeboat from a fixed structure such as an offshore drilling platform.

The system is intended to overcome the problems encountered when launching lifeboats on the weather or windward side of a drilling platform where there is a tendency for the lifeboat to be driven into the legs and pipework of the platform thus preventing rapid escape, for example in the case of fire and when burning debris may fall into the sea from a position directly above the boat.

It is intended that the system should enable the boat to be drawn a safe distance away from the platform once it is afloat.

According to the present invention, a system for launching a lifeboat from a fixed structure such as an off-shore drilling platform, comprising a submerged buoyancy device tethered to the bow of the lifeboat by means of a cable which passes, from the lifeboat to the buoyancy device, and is retained by a release mechanism fixed near the base of the structure, and by a submerged guide member fixed at a similar level but at a distance off the structure, the release mechanism being adapted to release the cable as the lifeboat descends from the structure such that consequent rapid ascent of the buoyancy device draws the cable around the guide member thus drawing the lifeboat bow in a direction away from the structure during descent, and towing the lifeboat rapidly away from the structure, once it is afloat.

The invention will now be described further, by way of example only, with reference to the accompanying drawing which illustrates schematically a fixed drilling platform with a lifeboat launching system embodying the invention.

A drilling platform 10 is supported on legs 11 above the sea bed 12. A number of lifeboats, one of which is illustrated at 13, are suspended around the platform 10 on davits 14. Access to the lifeboats is via the deck 15 forming part of the platform 10.

The launching system for each lifeboat comprises a buoyancy device 16 which is tethered by a cable 17 to the bow of the lifeboat 13.

The cable 17 passes vertically downwards from the lifeboat to a release mechanism in the form of an inverted hook 18 anchored to the sea bed at 19 near the base of the platform, or to one of the legs 11. At this point, the cable carries a fixed ring 26 which locates under hook 18. From there the cable passes horizontally over the sea bed to a second retaining member in the form of a pulley 20 anchored to the sea bed at 21, a distance off the platform. The cable then passes around a second pulley 22 fixed to the base of the buoyancy device 16 and is anchored beyond at 23 to the sea bed.

A marker buoy 24 is attached by a line 25 to the buoyancy device 16.

Hook 18, preferably made of stainless steel, comprises an inclined arm disposed at an angle of 45° or more with respect to a vertical stem, the latter being some 3 meters in height. A snatch weight 27 is suspended from a pulley 28 which rides on cable 17 between ring 26 and pulley 20.

Location of the buoyancy device 16 close to the sea bed, together with the low level horizontal run of cable 17 between hook 18 and pulley 20 ensures that there are no obstructions in the water, for craft approaching the drilling platform, save for the marker buoy 24 which is visible above the surface.

When it is required to launch the lifeboat, it is lowered in the usual manner from the davits 14 towards the surface. As the lifeboat descends, the cable above ring 26 becomes slack so that the ring 26 is released from hook 18 thus releasing the cable 17 which enables the buoyancy device 16 to rise sharply to draw the bow of lifeboat 13 in a direction away from the drilling platform. The arrangement of pulleys 20 and 22 provides a 2:1 ratio of descent of the lifeboat against ascent of the buoyancy device.

When the buoyancy device reaches the surface as indicated at 16' the lifeboat will have assumed a position as indicated at 13' distant from the drilling platform with the cable assuming the configuration as indicated at 17'.

The snatch weight 27 prevents a sudden snatch of the cable and rides towards pulley 20 as the buoyancy device rises thus ensuring a smooth operation of the system.

The distance of anchors 21 and 23 along the sea bed from the drilling platform may be 500 meters where the platform itself is some 150 meters above the sea bed and the depth of the water is in the region of 120 meters. The system causes the cable 17 to tow the lifeboat away from the platform by a distance of approximately 100 meters i.e. a safe distance from the platform.

Action of the snatch weight 27 may be enhanced or replaced by a compressible air bag on the buoyancy device which increases its buoyancy a the device ascends. The inherent buoyancy of the device 16 may be selected according to the depth of water and the distance off the platform, but is preferably in the region of 250 kilograms.

It will be appreciated that the lifeboat is caused to turn away from the platform as it descends onto the water, which is important in cases where it is released on the windward side. Once towed away from the platform the lifeboat will ride according to the weather on the end of cable 17. Since the cable will be attached to the lifeboat by a quick release shackle, may be released permitting the lifeboat to motor further away from the platform.

Preferably, the end of the cable to which the lifeboat is attached is provided with means which will not pass around guide pulley 20 so that the whole system may be recovered and reset for further use.

Conveniently, prior to use there will be means adjacent the lifeboat to indicate a continuing tension in cable 17 so that operators may check the serviceability of the system at all times. Furthermore, the location of marker buoys 24, one for each system, around the platform will provide a ready indication that all systems are properly set up and ready for use.

It is not intended to limit the invention to the above details. For example, there may be a 1:1 ratio of the cable around pulley 20 with the buoyancy device 16 merely attached to a free end of the cable. Alternatively, and in accordance with the depth of water available there may be a greater than 2:1 ratio by providing further pulleys.

The entire system will be constructed of non-corrodible materials.

The invention is not limited to the example described herein. For example, hook 18 and ring 26 may be replaced by a pulley with a device attached to cable 17 just above the pulley to release the cable therefrom as the lifeboat descends towards the water.

I claim:

1. A system for launching a lifeboat from a fixed base structure such as an off-short drilling platform, comprising a submerged buoyancy device tethered to the bow of the lifeboat by means of a towing cable which passes from the lifeboat to the submerged buoyancy device, a release mechanism fixed with respect to the base structure and retaining said towing cable before launch, and a submerged guide member fixed at a distance off the base structure, said towing cable passing around said guide member between the lifeboat and the buoyancy device, the release mechanism being arranged to release the towing cable completely therefrom as the lifeboat descends from the base structure such that no connection remains between the base structure and the lifeboat and between the base structure and the buoyancy device, and such that consequent free ascent of the buoyancy device draws the towing cable around the guide member and draws the lifeboat bow in a direction away from the structure during descent, such that the lifeboat is towed rapidly away from the base structure, once it is afloat.

2. A system according to claim 1, wherein the structure is an off-short drilling platform and wherein said cable passes between said release mechanism and said submerged guide member, horizontally over the sea bed.

3. A system according to claim 1, wherein the cable passes, after the submerged guide member, around a further guide member fixed to the base of the buoyancy device and is anchored beyond same substantially at the same level as the submerged guide member.

4. A system according to claim 3, wherein said submerged guide member and said further guide member are pulleys and serve to provide a 2:1 ratio of descent of the lifeboat against ascent of the buoyancy device.

5. A system according to claim 1, wherein said release mechanism is an inverted hook fixed with respect to the base structure, and adapted to retain said cable, and including means for releasing the cable from the hook in the form of a ring attached locally to the cable and releasable from the hook when the cable above the latter becomes slack.

6. A system according to claim 1, including a marker buoy attached by a line to the buoyancy device.

7. A system according to claim 1, including a snatch weight suspended from, and adapted to ride upon, the cable between the release mechanism and the submerged guide member.

8. A system according to claim 1, wherein the fixed structure is an off-shore drilling platform, and the submerged guide member is located some 500 meters along the sea bed from the base of the platform where the platform itself is some 150 meters above the sea bed and the depth of water is in the region of 120 meters.

9. A system according to claim 1, in which the cable is of sufficient length that the lifeboat may be towed away from the fixed structure by a distance of approximately 100 meters.

10. A system according to claim 1, wherein the inherent buoyancy of said buoyancy device is in the region of 250 kilograms.

11. A system according to claim 1, including means to indicate a maintained tension in the cable whereby operators may check the serviceability of the system at all times.

12. A system according to claim 1, wherein there is a 1:1 ratio of the cable around the submerged guide member with the buoyancy device attached to a free end of the cable.

* * * * *